US009358988B2

(12) United States Patent
Early

(10) Patent No.: US 9,358,988 B2
(45) Date of Patent: Jun. 7, 2016

(54) AUTOMATIC HOPPER CAR GATE OPENING AND CLOSING SYSTEM

(71) Applicant: AERO TRANSPORTATION PRODUCTS, INC., Independence, MO (US)

(72) Inventor: Stephen R. Early, Olathe, KS (US)

(73) Assignee: AERO TRANSPORTATION PRODUCTS, INC., Independence, MO (US)

( * ) Notice: Subject to any disclaimer, the term of this patent is extended or adjusted under 35 U.S.C. 154(b) by 326 days.

(21) Appl. No.: 14/103,959

(22) Filed: Dec. 12, 2013

(65) Prior Publication Data

US 2015/0166079 A1 Jun. 18, 2015

(51) Int. Cl.

| | |
|---|---|
| ***B61D 7/00*** | (2006.01) |
| ***B61D 7/20*** | (2006.01) |
| ***B61D 7/02*** | (2006.01) |

(52) U.S. Cl.

CPC ... *B61D 7/20* (2013.01); *B61D 7/02* (2013.01)

(58) Field of Classification Search

CPC ..... B61D 7/00; B61D 7/02; B61D 7/16; B61D 7/20; B61D 7/24; B61D 7/26

See application file for complete search history.

(56) References Cited

U.S. PATENT DOCUMENTS

| | | | | |
|---|---|---|---|---|
| 3,080,075 | A | 3/1963 | Giesking | |
| 3,187,684 | A | 6/1965 | Ortner | |
| 3,227,100 | A | 1/1966 | Smith et al. | |
| 3,316,858 | A * | 5/1967 | Fritz | B61D 7/30 105/241.2 |
| 3,396,675 | A | 8/1968 | Stevens | |
| 3,419,165 | A | 12/1968 | Haditsch | |
| 3,459,317 | A | 8/1969 | Shaver | |
| 3,596,609 | A | 8/1971 | Ortner et al. | |
| 4,194,450 | A | 3/1980 | Miller | |
| 4,222,333 | A | 9/1980 | Schuller | |
| 5,163,372 | A | 11/1992 | Galvan et al. | |
| 5,419,262 | A | 5/1995 | Turpin, Sr. | |
| 6,286,437 | B1 | 9/2001 | Lucas | |
| 6,363,863 | B1 * | 4/2002 | Dohr | B65D 90/545 105/247 |
| 6,571,718 | B2 * | 6/2003 | Lucas | B61D 7/20 105/282.3 |
| 6,748,841 | B1 | 6/2004 | Fritz | |
| 7,124,693 | B2 | 10/2006 | Lucas | |
| 7,171,907 | B2 * | 2/2007 | Early | B61D 7/30 105/247 |
| 7,367,271 | B2 * | 5/2008 | Early | B61D 7/20 105/282.2 |
| 7,806,057 | B2 | 10/2010 | Early | |

(Continued)

FOREIGN PATENT DOCUMENTS

| | | |
|---|---|---|
| CN | 2659767 | 12/2004 |
| GB | 160998 | 4/1921 |
| GB | 297926 | 10/1928 |

*Primary Examiner* — Jason C Smith

(74) *Attorney, Agent, or Firm* — Stinson Leonard Street LLP

(57) ABSTRACT

A hopper car gate with a frame, a door supported by the frame and horizontally moveable between open and closed positions, a rack mounted to the door, and first and second shafts supported by the frame. A first gear mounted to the first shaft engages the rack. Second and third mating gears are mounted to the first and second shafts, respectively. A hopper car with first and second hopper car gates mounted to first and second hoppers, respectively. Doors of the gates move horizontally to an open position in opposite directions from each other with shaft rotation in the same direction. A hopper car gate opening and closing system including a hopper car gate with a pair of shafts, a gear mounted on each shaft, and racks that are positioned to engage the gears as the gate moves with respect to the racks.

17 Claims, 3 Drawing Sheets

(56) References Cited

U.S. PATENT DOCUMENTS

| | | | | |
|---|---|---|---|---|
| 7,814,842 | B2 | 10/2010 | Early | |
| 7,819,067 | B2 | 10/2010 | Early | |
| 8,371,235 | B1 | 2/2013 | Early | |
| 2006/0185553 | A1 | 8/2006 | Taylor | |
| 2009/0235840 | A1* | 9/2009 | Early | B61D 7/20 105/282.3 |
| 2010/0107924 | A1* | 5/2010 | Early | B61D 7/20 105/282.3 |
| 2013/0233199 | A1 | 9/2013 | Early | |
| 2015/0166079 | A1* | 6/2015 | Early | B61D 7/02 105/282.3 |

* cited by examiner

AUTOMATIC HOPPER CAR GATE OPENING AND CLOSING SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is related generally to hopper cars and in particular to a hopper car gate configured for use with an automatic hopper car gate opening and closing system.

2. Description of Related Art

Hopper cars are commonly used to transport bulk materials. Hopper cars include one or more hoppers which hold bulk materials or other cargo for shipment. Each hopper has a discharge opening at its bottom in order to discharge the cargo upon arrival at its intended destination. A gate is joined to each opening to control the discharge of cargo from the hopper. Typically, the gate will have a frame defining an opening and a door moveable between a closed position which blocks the opening and an open position which allows cargo to exit through the opening. An opening mechanism allows a user to move the door between its closed and open positions.

Most conventional hopper car gates are opened and closed by an operator with the assistance of a pneumatic tool configured for use with the opening mechanism of the gate. When a hopper car enters a facility for unloading, the operator must use the tool to open each of the gates on the hopper car. As the car exits the facility, the operator must again use the tool to close each of the gates. When many hopper cars are joined together, the time spent opening and closing all of the gates can be significant. Further, with each gate, the operator must determine how the tool needs to be set in order to either open or close the gate. If the operator incorrectly sets the tool, the gate may be damaged when the operator attempts to open or close the gate. For example, if the operator sets the tool to close a gate when the gate is already closed, the tool may force the door of the gate into a position in which it was not designed to go, which may cause damage to the gate that is expensive to fix.

BRIEF SUMMARY OF THE INVENTION

A hopper car gate in accordance with the present invention includes a frame, a door that is supported by the frame and is horizontally moveable between open and closed positions, a rack that is mounted to the door, and first and second shafts that are supported by the frame. The first shaft extends outward from a first side of the frame, and the second shaft extends outward from a second side of the frame. A first gear that is mounted to the first shaft engages the rack on the door. A second gear that is mounted to the first shaft engages a third gear that is mounted to the second shaft. Preferably, the door may be opened from the first side of the frame by rotating the first shaft in a first direction, and the door may be opened from the second side of the frame by rotating the second shaft in a second direction, which rotates the first shaft in the first direction due to the second and third gears.

Preferably, an operator positioned on the first side of the frame can rotate the first shaft in a counter-clockwise direction to open the door and a clockwise direction to close the door, and an operator positioned on the second side of the frame can rotate the second shaft in a counter-clockwise direction to open the door and a clockwise direction to close the door. This configuration reduces operator confusion because no matter on which side of the gate the operator is positioned, the operator will rotate the shaft that extends outward from that side of the gate in a counter-clockwise direction to open the door and a clockwise direction to close the door. Alternatively, the gate may be configured so that rotation in a clockwise direction opens the door and rotation in a counter-clockwise direction closes the door.

A hopper car in accordance with the present invention includes first and second hoppers, a first gate mounted to the first hopper, and a second gate mounted to the second hopper. The first gate includes a first door and a first shaft that is coupled to the first door. The first door moves horizontally in a first direction from a closed position to an open position when the first shaft is rotated in a second direction. The second gate includes a second door and a second shaft that is coupled to the second door. The second door moves horizontally in a third direction, which is opposite to the first direction, from a closed position to an open position when the second shaft is rotated in the second direction. The first and second gates are preferably substantially similar and are mounted to the hoppers so that they are rotated 180 degrees from each other.

A hopper car gate opening and closing system in accordance with the present invention has a hopper car gate and first and second racks. The hopper car gate has a frame, a door that is supported by the frame and horizontally moveable between open and closed positions, and first and second shafts that are supported by the frame. The first shaft extends outward from a first side of the frame, and the second shaft extends outward from a second side of the frame. The first shaft is coupled to the door and to the second shaft. A first gear is mounted to the first shaft adjacent the first side of the frame, and a second gear is mounted to the second shaft adjacent the second side of the frame. The first and second racks are positioned to engage the first and second gears, respectively, as the hopper car gate moves with respect to the racks. As the hopper car gate moves in a first direction, the door moves to its open position when the first rack engages the first gear. As the hopper car gate continues to move in the same, first direction, the door moves to its closed position when the second rack engages the second gear. This system automatically opens and closes the door of a hopper car gate as the railcar to which the gate is mounted moves with respect to the first and second racks. By opening and closing the doors in this manner, labor costs are saved and the time necessary to unload hopper cars is reduced.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
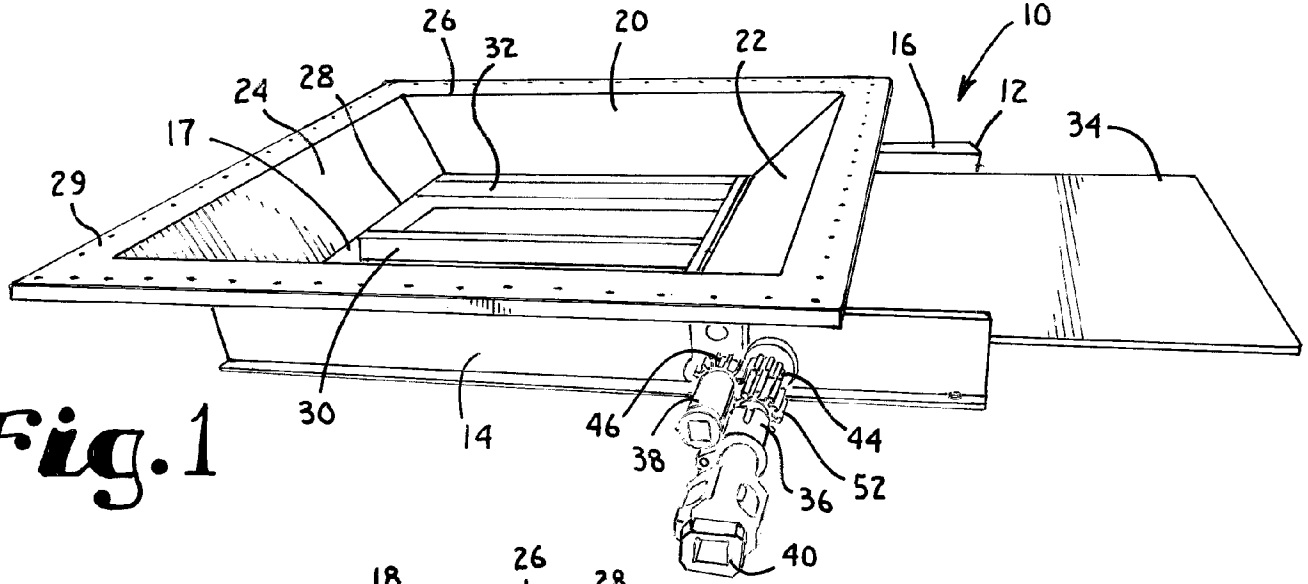
FIG. 1 is a perspective view of a hopper car gate in accordance with the present invention.

A hopper car gate in accordance with the present invention is shown generally as 10 in FIG. 1. Hopper car gate 10 has a frame 12 with first and second sides 14 and 16 joined by a first end (not shown) and a second end 17. Side walls 18 (FIG. 2) and 20 and end walls 22 and 24 are joined to the frame 12. Side and end walls 18, 20, 22, and 24 define top and bottom openings 26 and 28, respectively. A flange 29 is mounted to and extends away from an upper portion of side and end walls 18, 20, 22, and 24. Flange 29 includes openings that are configured to receive fasteners for joining hopper car gate 10 to the hopper of a railcar. Three frame rails, two of which are shown in FIG. 1 as 30 and 32, extend between the first end and the second end 17 of the frame 12 just below bottom opening 28. A door 34 is supported by the frame rails 30 and 32 adjacent opening 28. Door 34 is moveable horizontally between a closed position, in which it blocks opening 28, and an open position, in which material is free to flow through opening 28.

Figure 2:
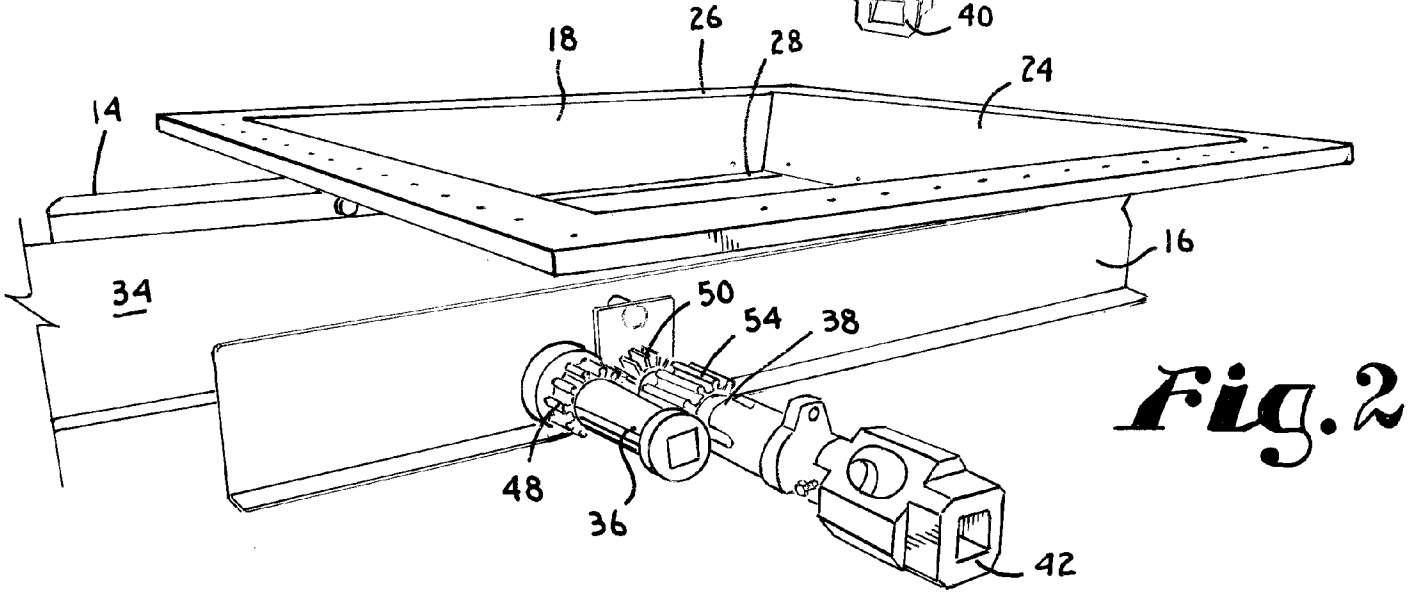
FIG. 2 is a perspective view of the hopper car gate shown in FIG. 1.
Figure 3:
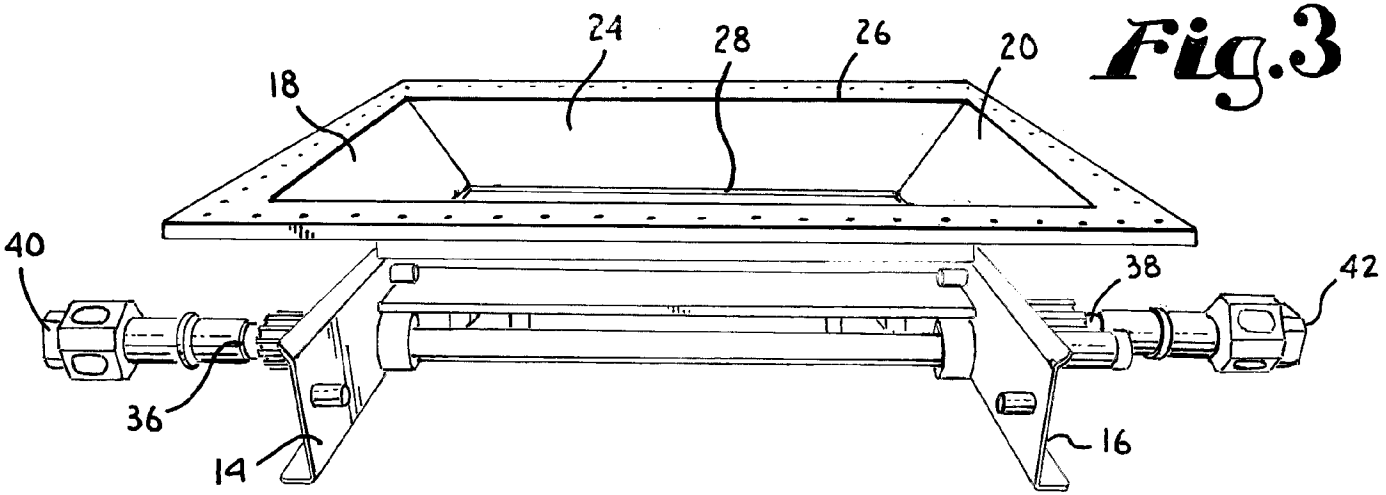
FIG. 3 is a front perspective view of the hopper car gate shown in FIG. 1.

First and second shafts 36 and 38 are supported by frame 12 such that they are rotatable with respect to the frame 12. Each of first and second shafts 36 and 38 extends through an opening in first side 14 and an opening in second side 16. Shafts 36 and 38 are parallel and adjacent each other. Each of first and second shafts 36 and 38 includes a portion that extends outward and away from first side 14, as shown in FIG. 1, and a portion that extends outward and away from second side 16, as shown in FIG. 2. Bearings or bushings (not shown) may be mounted within the first and second sides 14 and 16 to receive first and second shafts 36 and 38 and facilitate their rotation with respect to frame 12. A first socket 40 is mounted to the end of first shaft 36 adjacent first side 14, and a second socket 42 (FIG. 2) is mounted to the end of second shaft 38 adjacent second side 16. Each of first and second sockets 40 and 42 is configured for receiving a tool (not shown) with the ability to transfer torque to sockets 40 and 42 for rotating shafts 36 and 38.

A pair of gears (not shown) are mounted to second shaft 38 between the first side 14 and second side 16 of frame 12. Each of these gears engages a separate gear rack (not shown) mounted to the underside of door 34. As second shaft 38 rotates, the gears engage the gear racks to move door 34 between its closed and open positions.

Referring to FIG. 1, mating gears 44 and 46 are mounted to first and second shafts 36 and 38, respectively, adjacent first side 14 of frame 12. Referring to FIG. 2, another pair of mating gears 48 and 50 are mounted to first and second shafts 36 and 38, respectively, adjacent second side 16 of frame 12. When a tool is inserted into socket 40, shown in FIG. 1, and first shaft 36 is rotated, the pair of mating gears 44 and 46 and the pair of mating gears 48 and 50 transfer torque from first shaft 36 to second shaft 38 so that the gears (not shown) on second shaft 38 can engage the racks (not shown) on door 34 to open and/or close the door 34. Due to the pairs of mating gears 44 and 46 and 48 and 50, first and second shafts 36 and 38 rotate at the same time, but in opposite directions. Mating gears 44, 46, 48, and 50 may alternatively be mounted to a portion of shafts 36 and 38 positioned between first and second sides 14 and 16 of frame 12.

Referring to FIG. 2, when second shaft 38 is rotated in a counter-clockwise direction (when viewed from the side of gate 10 shown in FIG. 2), or first shaft 36 is rotated in a clockwise direction, door 34 moves horizontally to its open position. When second shaft 38 is rotated in a clockwise direction (when viewed from the side of gate 10 shown in FIG. 2), or first shaft 36 is rotated in a counter-clockwise direction, door 34 moves horizontally to its closed position. Thus, if first shaft 36 is rotated in a particular direction and then second shaft 38 is rotated in the same direction, door 34 moves in one direction as first shaft 36 is rotated and then in an opposite direction as second shaft 38 is rotated.

Because gate 10 includes two shafts 36 and 38 that are coupled to rotate at the same time in opposite directions, and the shafts 36 and 38 have sockets 40 and 42, respectively, positioned on opposite sides of the gate 10, no matter on which side of the gate an operator is positioned, the operator rotates sockets 40 and 42 in a counter-clockwise direction to open door 34 and in a clockwise direction to close door 34. Thus, referring to FIG. 1, socket 40 is rotated in a counter-clockwise direction (when viewed from the side of gate 10 shown in FIG. 1) to open door 34 and in a clockwise direction to close door 34. Referring to FIG. 2, socket 42 is rotated in a counter-clockwise direction (when viewed from the side of gate 10 shown in FIG. 2) to open door 34 and in a clockwise direction to close door 34. One advantage of this configuration is that it reduces operator confusion because an operator can always rotate sockets 40 and 42 in the same direction to open, or close, door 34 no matter on which side of the gate 10 the operator is positioned. Reducing operator confusion will likely reduce instances of socket 40 or 42 rotation in the wrong direction, which is a frequent cause of damage to hopper car gates.

As shown in FIG. 1, a gear 52 is mounted to first shaft 36 adjacent first side 14 of frame 12 between socket 40 and gear 44. A gear 54, shown in FIG. 2, is mounted to second shaft 38 adjacent second side 16 of frame 12 between socket 42 and gear 50. As discussed in detail below with respect to the gate shown in FIGS. 5 and 6, each of gears 52 and 54 is positioned to engage a rack, such as the rack 126 shown in FIG. 5, as the gate 10 moves with respect to the rack 126. Gears 52 and 54 are preferably wider than gears 44, 46, 48, and 50 in order to ensure adequate engagement with rack 126. Each of gears 52 and 54 may comprise two gears positioned side-by-side.

Figure 4:
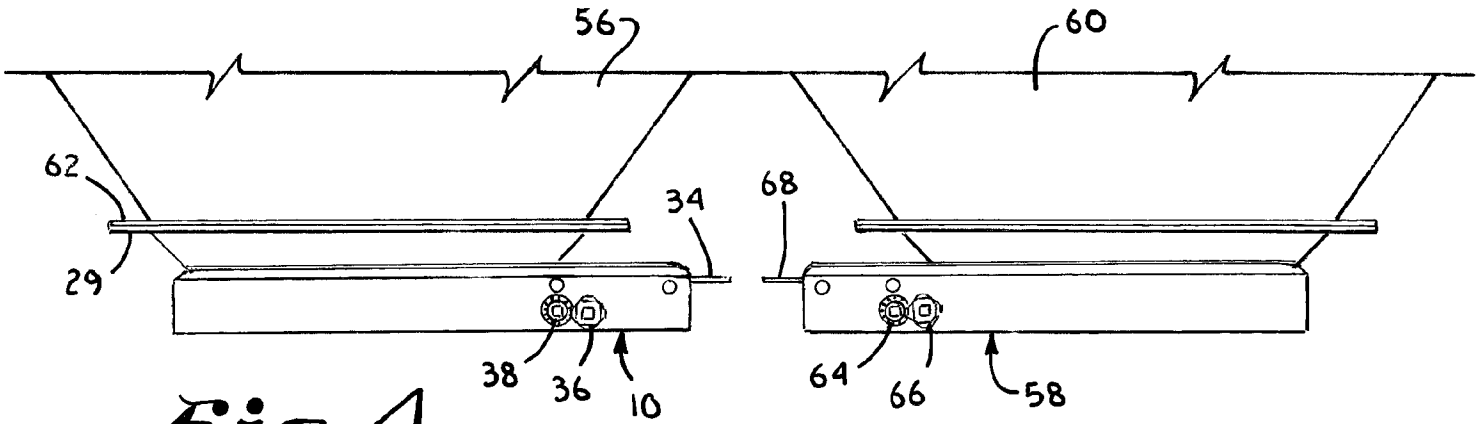
FIG. 4 is a side elevational view showing two of the hopper car gates of FIG. 1 mounted to a railcar.

FIG. 4 shows gate 10 mounted to a hopper 56, and another gate 58, which is substantially similar to gate 10, mounted to a hopper 60 that is adjacent hopper 56. Hoppers 56 and 60 are preferably part of a railroad hopper car. Flange 29 of gate 10 is mounted with fasteners to a flange 62 that surrounds the lower opening of hopper 56, and gate 58 is mounted to hopper 60 in a similar manner except that gate 58 is rotated 180 degrees from gate 10. When shaft 36 is rotated in a counter-clockwise direction (when viewed as shown in FIG. 4), door 34 of gate 10 moves from its closed position to its open position in a horizontal direction toward gate 58. Gate 58 includes first and second shafts 64 and 66 coupled in a similar manner as the shafts 36 and 38 of gate 10. When second shaft 66 of gate 58 is rotated in a counter-clockwise direction (when viewed as shown in FIG. 4), a door 68 of gate 58 moves from its closed position to its open position in a horizontal direction toward gate 10. The doors 34 and 68 of gates 10 and 58, respectively, move toward each other and in opposite directions as each moves from its closed position to its open position. The shafts 36 and 66 of gates 10 and 58, respectively, are rotated in the same direction to open doors 34 and 68, respectively, and the shafts 36 and 66 are rotated in the same direction to close doors 34 and 68, respectively.

Figure 5:
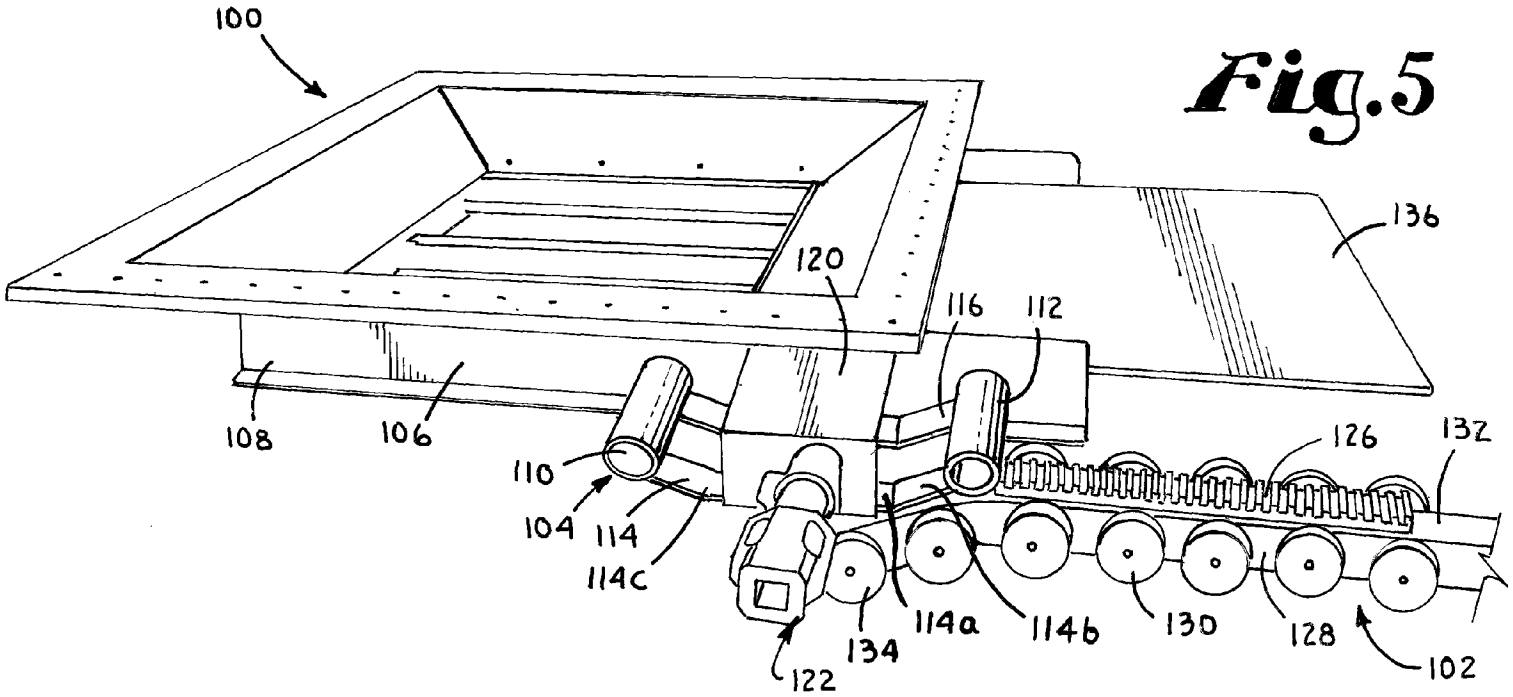
FIG. 5 is a perspective view of an alternative embodiment of hopper car gate in accordance with the present invention.

An alternative embodiment of hopper car gate in accordance with the present invention is shown generally as 100 in FIG. 5. Gate 100 is configured for use with a hopper car gate opening and closing system 102. Except for the specific differences described below, gate 100 is substantially similar to gate 10, which is shown in FIG. 1 and discussed in detail above. Gate 100 includes a guide structure 104 that is mounted to and extends outward from a first side 106 of a frame 108. Guide structure 104 includes two cylinders 110 and 112 that are mounted to and extend outward from first side 106. Guides 114 and 116 are mounted to each of the cylinders 110 and 112. Guide 116 is positioned adjacent first side 106 of frame 108, while guide 114 is spaced farther from first side 106. Guides 114 and 116 have substantially the same structure and are mounted to cylinders 110 and 112 in substantially the same manner. Accordingly, only the specific structure of guide 114 is described in detail herein. Guide 114 includes a generally horizontal portion 114*a* and inclined portions 114*b* and 114*c*. Each of the inclined portions 114*b* and 114*c* is joined with one end of horizontal portion 114*a* and extends upward from the horizontal portion 114*a* to one of cylinders 110 and 112.

Guide structure 104 also includes supports 118 and 120 (FIG. 6) each joined with first side 106. Support 118 extends from first side 106 to the horizontal portion of guide 116, and support 120 extends from first side 106 to the horizontal portion 114*a* of guide 114. Cylinders 110 and 112 and supports 118 and 120 rigidly join guides 114 and 116 to frame 108. Supports 118 and 120 include openings through which a shaft 122 passes. A gear 124 is mounted to the shaft 122 and is positioned between the guides 114 and 116.

Figure 6:
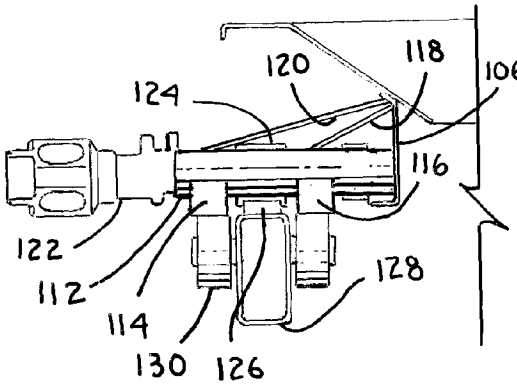
FIG. 6 is a front elevational view of a portion of the hopper car gate shown in FIG. 5.

Hopper car gate opening and closing system 102 includes a gear rack 126 mounted to the top of a frame rail 128. Rollers, one of which is identified as 130, are mounted to both sides of the frame rail 128. As shown in FIG. 6, gear 124 is positioned to engage gear rack 126, and rollers 130 are positioned to engage a lower surface of guides 114 and 116. The lower surface of guides 114 and 116 is lower than gear 124, and rack 126 is positioned higher than rollers 130. Frame rail 128 includes a generally horizontal section 132 and an inclined transition section 134 that extends downward from the front of the horizontal section 132. Frame rail 128 is preferably mounted to a vertical lift (not shown) at a hopper car unloading facility that is capable of raising or lowering the frame rail 128 to the appropriate height at which rack 126 is adequately positioned to engage gear 124. Frame rail 128 may be spring-loaded to enable it to move upward as material is unloaded from the railcar to which gate 100 is mounted and the railcar rises.

Like gate 10 described above, gate 100 has another shaft (not shown) that is parallel to shaft 122 and that has a socket (not shown) and gear (not shown) mounted to it on the opposite side of the gate 100 as the side shown in FIG. 5. A guide structure (not shown) similar to guide structure 104 is mounted to the opposite side of the gate 100 as the side shown in FIG. 5. Hopper car gate opening and closing system 102 includes another frame rail (not shown) and gear rack (not shown) for engaging the guide structure (not shown) and gear (not shown) on the opposite side of gate 100 as the side shown in FIG. 5.

Hopper car gate opening and closing system 102 is preferably positioned so that as the railcar to which gate 100 is mounted moves toward it, rack 126 engages gear 124 to rotate shaft 122 in a clockwise direction (when viewed from the side of the gate 100 shown in FIG. 5). Clockwise rotation of shaft 122 moves door 136 from its open position to its closed position as described above with respect to gate 10. Rollers 130 on inclined transition section 134 engage the inclined portions 114*b* of guides 114 and 116 to gradually guide gear 124 into engagement with rack 126. Preferably, the frame rail (not shown) and gear rack (not shown) positioned on the opposite side of gate 100 as the side shown in FIG. 5 are positioned so that the gate 100 engages them prior to engaging rack 126. Gate 100 includes a gear, similar to gear 54 shown in FIG. 2, that engages the gear rack (not shown) positioned on the opposite side of gate 100 as the side shown in FIG. 5, for opening door 136. While rack 126 is shown in FIG. 5 so that gate 100 engages it as gate 100 moves from left to right, rack 126 may be positioned on the opposite side of gear 124 so that gate 100 engages rack 126 as gate 100 moves from right to left, in which case shaft 122 rotates in a counter-clockwise direction and door moves to its open position.

In operation, the door 34 of gate 10, shown in FIGS. 1 and 2, is moved from its closed position to its open position by inserting a tool into socket 40 (FIG. 1) and rotating shaft 36 in a counter-clockwise direction (when viewed as shown in FIG. 1) or by inserting a tool into socket 42 (FIG. 2) and rotating shaft 38 in a counter-clockwise direction (when viewed as shown in FIG. 2). Door 34 is moved from its open position to its closed position by rotating shaft 36 (FIG. 1) in a clockwise direction (when viewed as shown in FIG. 1) or by rotating shaft 38 (FIG. 2) in a clockwise direction (when viewed as shown in FIG. 2).

Shaft 36 may be rotated in the counter-clockwise direction to open door 34 by moving the gate 10 from right to left (when viewed as shown in FIG. 1) as gear 52 engages a stationary rack such as the rack 126 shown in FIG. 5. Shaft 36 may be rotated in the clockwise direction to close door 34 by moving the gate 10 from left to right (when viewed as shown in FIG. 1) as gear 52 engages a stationary rack such as the rack 126 shown in FIG. 5. Shaft 38 may be rotated in the counter-clockwise direction to open door 34 by moving the gate 10 from right to left (when viewed as shown in FIG. 2) as gear 54 engages a stationary rack such as the rack 126 shown in FIG. 5. Shaft 38 may be rotated in the clockwise direction to close door 34 by moving the gate 10 from left to right (when viewed as shown in FIG. 2) as gear 54 engages a stationary rack such as the rack 126 shown in FIG. 5.

Gate 100 operates in a substantially similar manner as gate 10. As the railcar to which gate 100 is mounted pulls into a hopper car unloading facility, hopper car gate opening and closing system 102 engages the gate 100 to open door 136, and as the railcar pulls out of the hopper car unloading facility, hopper car gate opening and closing system 102 engages gate 100 to close door 136. Accordingly, door 136 may automatically open and close without operator input as the railcar enters and exits the unloading facility.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A hopper car gate comprising:

a frame comprising first and second sides, wherein the frame defines an opening positioned between the first and second sides;

a door supported by the frame adjacent the opening, wherein the door is horizontally moveable between open and closed positions;

a rack mounted to the door;

a first shaft supported by the frame and extending outward from the first side of the frame;

first and second gears mounted to the first shaft, wherein the first gear engages the rack;

a second shaft supported by the frame and extending outward from the second side of the frame; and a third gear mounted to the second shaft, wherein the third gear engages the second gear.

2. The hopper car gate of claim 1, wherein the door moves to its open position when the first shaft is rotated in a first direction.

3. The hopper car gate of claim 2, wherein when the second shaft is rotated in the first direction, the first shaft rotates in a second direction and the door moves to its closed position.

4. The hopper car gate of claim 1, further comprising a fourth gear mounted to the first shaft and a fifth gear mounted to the second shaft, wherein the fourth and fifth gears are positioned to engage, respectively, second and third racks as the frame moves with respect to the second and third racks.

5. The hopper car gate of claim 1, wherein each of the first and second shafts extends through both of the first and second sides of the frame.

6. A hopper car comprising:

first and second hoppers;

a first gate mounted to the first hopper, wherein the first gate comprises a first door and a first shaft that is coupled to the first door, wherein the first door moves horizontally in a first direction from a closed position to an open position when the first shaft is rotated in a second direction; and a second gate mounted to the second hopper, wherein the second gate comprises a second door and a second shaft that is coupled to the second door, wherein the second door moves horizontally in a third direction from a closed position to an open position when the second shaft is rotated in the second direction, and wherein the first direction is opposite to the third direction.

7. The hopper car of claim 6, wherein the first and second hoppers are adjacent each other and the first and second doors move toward each other as each moves from its closed position to its open position.

8. The hopper car of claim 6, wherein the first and second gates are substantially similar.

9. The hopper car of claim 6, wherein the first gate further comprises:

a third shaft that is coupled with the first shaft;

a first gear mounted to the third shaft; and a first rack mounted to the first door, wherein the first rack engages the first gear.

10. The hopper car of claim 9, wherein the second gate further comprises:

a fourth shaft that is coupled with the second shaft;

a second gear mounted to the second shaft; and a second rack mounted to the second door, wherein the second rack engages the second gear.

11. The hopper car of claim 10, wherein the first gate further comprises third and fourth mating gears mounted to the first and third shafts, respectively, and wherein the second gate further comprises fifth and sixth mating gears mounted to the second and fourth shafts, respectively.

12. The hopper car gate of claim 11, further comprising a seventh gear mounted to the first shaft and an eighth gear mounted to the second shaft, wherein the seventh and eighth gears are positioned to engage, respectively, third and fourth racks as the first and second hoppers move with respect to the third and fourth racks.

13. A hopper car gate opening and closing system comprising:

a hopper car gate comprising:

a frame comprising first and second sides, wherein the frame defines an opening positioned between the first and second sides;

a door supported by the frame adjacent the opening, wherein the door is horizontally moveable between open and closed positions;

a first shaft supported by the frame and extending outward from the first side of the frame, wherein the first shaft is coupled to the door;

a second shaft supported by the frame and extending outward from the second side of the frame, wherein the second shaft is coupled to the first shaft;

a first gear mounted to the first shaft adjacent the first side of the frame;

a second gear mounted to the second shaft adjacent the second side of the frame; and first and second racks positioned to engage the first and second gears, respectively, as the hopper car gate moves with respect to the first and second racks, wherein as the hopper car gate moves in a first direction the door moves to its open position when the first rack engages the first gear, and wherein as the hopper car gate moves in the first direction the door moves to its closed position when the second rack engages the second gear.

14. The system of claim 13, wherein the first and second racks are mounted on top of first and second frame rails, respectively, wherein first and second sets of rollers are mounted to the first and second frame rails, respectively.

15. The system of claim 14, wherein the hopper car gate further comprises a first roller guide mounted to the first side of the frame and a second roller guide mounted to the second side of the frame, wherein the first and second roller guides engage the first and second sets of rollers, respectively, as the hopper car gate moves with respect to the first and second racks.

16. The system of claim 13, wherein the hopper car gate further comprises third and fourth mating gears mounted to the first and second shafts, respectively.

17. The system of claim 16, wherein the hopper car gate further comprises a fifth gear mounted to the first shaft that engages a third rack mounted to the door.

* * * * *